US005370100A

United States Patent [19]

Benedikt et al.

[11] Patent Number: 5,370,100

[45] Date of Patent: Dec. 6, 1994

[54] CONNECTING PART FOR IGNITION DEVICE

[75] Inventors: Walter Benedikt, Kornwestheim; Werner Herden, Gerlingen; Manfred Vogel, Ditzingen Heimerdingen, all of Germany

[73] Assignee: Robert Bosch GmbH, Stuttgart, Germany

[21] Appl. No.: 111,713

[22] Filed: Aug. 25, 1993

[30] Foreign Application Priority Data

Oct. 9, 1992 [DE] Germany ..... 4234077

[51] Int. Cl.[5] ..... F02P 3/12

[52] U.S. Cl. ..... 123/654; 123/643; 123/653; 313/124

[58] Field of Search ..... 123/643, 653, 654, 655, 123/656, 627, 634, 169 R; 313/124, 44, 217, 49, 51, 325, 220; 336/96; 315/57, 58, 59, 62

[56] References Cited

U.S. PATENT DOCUMENTS

| | | | |
|---|---|---|---|
| 1,554,252 | 9/1925 | Smith | 123/654 |
| 3,535,582 | 10/1970 | Kawiecki | 313/217 |
| 3,702,952 | 11/1972 | Cassidy et al. | 317/62 |
| 3,876,894 | 4/1975 | Peche | 313/44 |
| 3,995,183 | 11/1976 | Lechner et al. | 313/124 |
| 4,082,980 | 4/1978 | Yoshikawa et al. | 315/59 |
| 4,123,688 | 10/1978 | Yoshikawa et al. | 315/58 |
| 4,277,724 | 7/1981 | Beeghley | 315/57 |
| 4,514,712 | 4/1985 | McDougal | 336/96 |
| 4,751,430 | 6/1988 | Muller et al. | 315/57 |
| 4,993,395 | 2/1991 | Vogel et al. | 123/643 |

FOREIGN PATENT DOCUMENTS

| | | | |
|---|---|---|---|
| 0143941 | 9/1980 | Germany | 123/653 |

*Primary Examiner*—R. A. Nelli
*Attorney, Agent, or Firm*—Michael J. Striker

[57] ABSTRACT

A connection part for an ignition device, arranged between an ignition coil and a spark plug for incorporating in a cylinder head of an internal combustion engine, has an isolation housing, a high voltage switching element located in the isolation housing and during application of a trigger voltage is transferred reversibly in an electrically jump-like fashion to an electrically conductive condition, a first junction element located at one end of the high voltage switching element and connected with one pole of the latter and also connectable with a high voltage terminal of the ignition coil which leads to an output voltage of the ignition coil, a second junction element provided at another end of the high voltage switching element and connected with another pole of the latter and provided for receiving a terminal pin of the spark plug, and an element associated with the isolation housing for increasing a capacity region between the high voltage switching element and the first junction element.

11 Claims, 1 Drawing Sheet

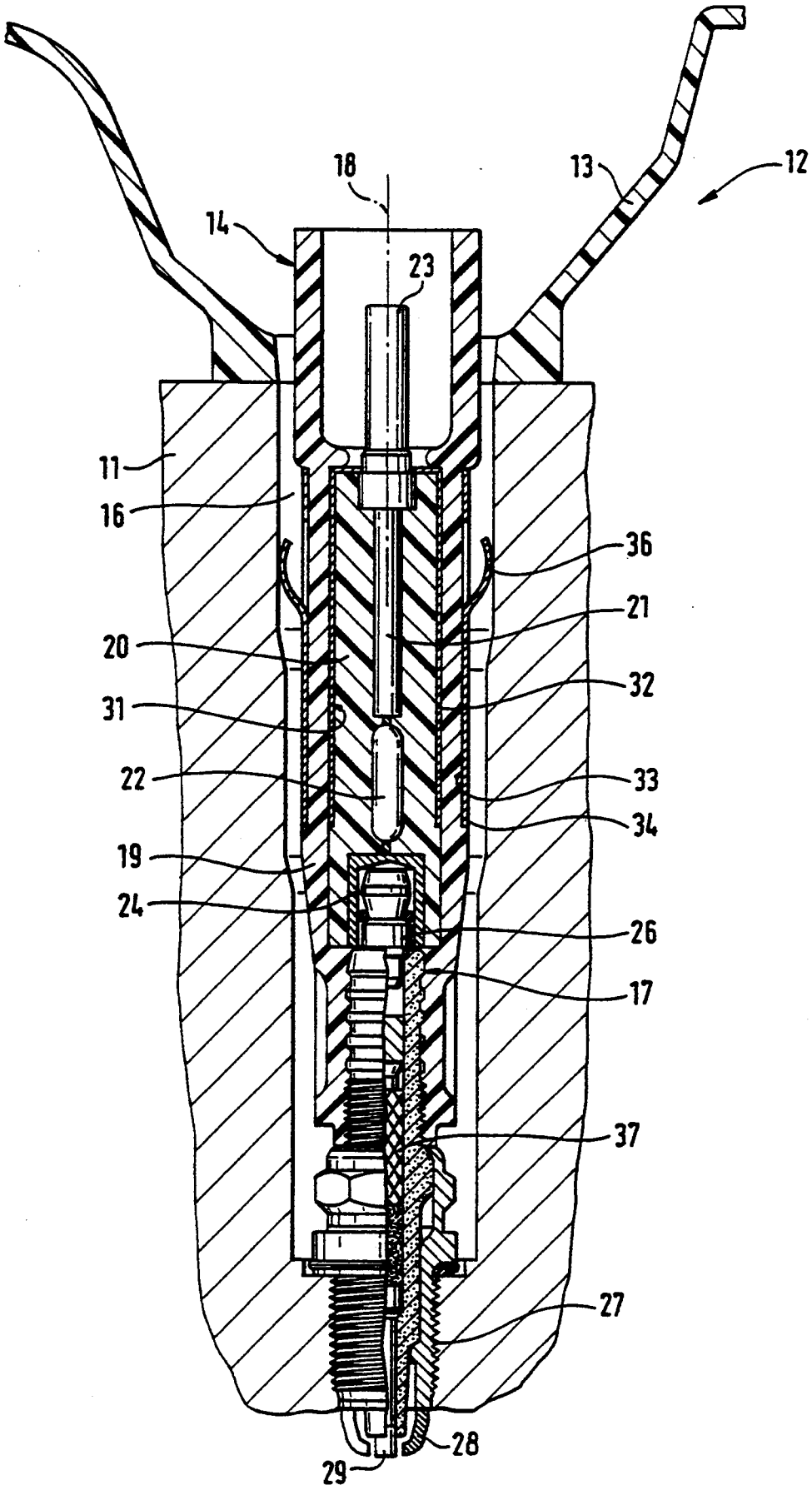
18
13
12
14
23
11
16
36
21
20
32
31
22
33
34
19
24
26
17
37
27
28
29

CONNECTING PART FOR IGNITION DEVICE

BACKGROUND OF THE INVENTION

The present invention relates to a connecting part for an ignition device for an internal combustion engine.

More particularly, it relates to a connecting part for incorporation into a cylinder head of an internal combustion engine.

Connecting parts of the above-mentioned general type are known in the art. In particular a connection part is known which is formed as a spark plug in view of its utilization and has a high voltage switching element formed as a trigger diode supplying voltage to the spark plug. This high voltage switching element switches from an electrically blocking to an electrically conducting condition in a jump-like fashion with the trigger voltage supplied to the ignition coil of the ignition device and supplies the subsequent spark plugs with a voltage jump. Therefore it substantially eliminates the effect of shunting at the spark plugs, which makes difficult the formation of the ignition spark at the electrodes of the spark plugs.

It is known that the voltage jump released by the high voltage switching element reaches the ignition voltage required for forming the ignition sparks at the plug electrode. The voltage jump is a partial voltage of the trigger voltage which structurally depends on the design of the high voltage switching element. The trigger voltage is smaller than the output voltage of the ignition coil by a voltage loss.

If the energy flow from the ignition coil to the spark plug corresponding to the ignition device is considered, the voltage loss which is produced due to the capacity distribution in the ignition device, depending on the location of the high voltage switching element, increases with the increase of the sum of the preceding and the subsequent capacity with respect to the preceding capacity. For compensating the voltage loss, the high voltage switching element must be designed for a corresponding higher trigger voltage than the ignition voltage in order to reach a predetermined average ignition voltage. Therefore, a very high initial voltage must be provided at the ignition coil. The high voltage is however connected with a reliability risk, since undesirable capacitative ground discharges can occur with electrode erosion at the spark plugs. In addition, the high voltage switching element and the ignition coil must be high voltage resistant, which leads to an increased price of these elements

SUMMARY OF THE INVENTION

Accordingly, it is an object of the present invention to provide a connection part of an ignition device, which avoids the disadvantages of the prior art.

In keeping with these objects and with others which will become apparent hereinafter, one feature of the present invention resides, briefly stated, in a connection part of an ignition device in which a structural element which increases the capacity of the region between the high voltage switching element and the connecting element is associated with an isolation housing.

When the connection part is designed in accordance with the present invention, it provides for an ignition device which operates with low voltage levels.

This is achieved by associating the capacity increasing structural unit with the isolation housing and the utilization of a high voltage switching element with low trigger voltage and as a result also the utilization of an ignition coil with low output voltage, which reduce the manufacturing costs of the ignition device.

In accordance with another feature of the present invention, the structural element can be formed as a tubular capacitor arranged outside of the isolation housing. One capacitor pole can be formed by a metal cup having a high voltage potential and surrounded by an isolating surface forming the dielectric, while the other capacitor pole can be formed as a metal screen which surrounds the isolation surface.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single Figure of the drawing is a view schematically showing an ignition device in accordance with the present invention, partially sectioned.

DESCRIPTION OF A PREFERRED EMBODIMENT

A connection part in accordance with the present invention is used for an ignition device for a multi-cylinder internal combustion engine, which due to its utilization operates as a spark plug connector, and for each cylinder the same ignition unit with an ignition coil and an integrated spark plug connector is utilized.

The single Figure of the drawing shows a cross-section of a cylinder head 11 of an internal combustion engine with an ignition unit 12 mounted on it in a not-shown manner. Only its ignition coil 13 is shown, and its spark plug connector 14 is connected with a spark plug 17 mounted in a plug shaft 16 of the cylinder head 11.

The spark plug connector 14 with a longitudinal axis 18 has an outer basically cylindrical sleeve 19 composed of silicone rubber, an injection molding-produced duraplastic isolation housing 20 having a cylindrical shape, a pin-shaped connecting element 21 located inside the isolation housing 20, and a high voltage switching element 22 connected with the connecting element 21 electrically in series and having a cylindrical outer shape. The high voltage switching element 22 is formed as a trigger diode. The pin shaped connecting element 21 and the cylindrical high voltage switching element 22 are directly embedded in the isolation housing 20.

A junction element 23 extending outwardly beyond the isolation housing 20 is provided at the free end of the connecting element 21 for the not-shown high voltage terminal of the ignition coil 13. A junction part 24 is embedded in the isolation housing 20 at the free end of the high voltage switching element 22 and has an opening at the end side of the isolation housing 20 for receiving a terminal pin 26 of the spark plug 17. The spark plug 17 is screwed in a known manner into a threaded opening 27 of the cylinder head 11. At its end it carries a mass electrode 28 located opposite to the terminal pin 26 and a central electrode 29 between which a spark discharge occurs during applying an ignition voltage to the middle electrode 29.

Depending on the place of integration of the high voltage switching element 22, a capacity distribution is produced along the above-described arrangement in the direction of the energy flow from the ignition coil 13 to the spark plug 17. The capacity distribution includes a pre-capacity composed of the capacity of the ignition coil 13 and the part of the spark plug connector 14 which is connected with it before the place of integration of the high voltage switching element 22 relative to ground potential, and a post-capacity relative to ground potential composed of the capacity of the part of the spark plug connector 14 between the high voltage switching element 22 and the spark plug 17, as well as the capacity of the spark plug 17. These two capacities are formed without an additional foreign circuitry out of the structural type and the arrangement on the integrating location of the above-mentioned structural parts, in particular from their distance to the cylinder head 11 which is at ground potential.

In accordance with the present invention, a hollow cylindrical metal cup 32 is arranged between the junction element 23 and the junction part 24 on an outer side 31 of the isolation housing 20, and a metal hollow cylindrical screen 34 is arranged on an outer surface 33 of the sleeve 19. The metal cup 32 is electrically connected via the junction element 23 with the high voltage terminal of the ignition coil 13. The metal screen 34 is in a power connection and electrical connection with the cylinder head 11 at ground potential, via springy tongues 36 mounted on the screen. In principle, the screen 34 can be also provided with a screen voltage with a value located between the output voltage of the ignition coil 13 and the ground potential. Also, the screen 34 together with the ignition coil 13 can be electrically conductively mounted via mounting elements on the cylinder head 11 which is at ground potential.

Therefore, between the metal cup 32 and the screen 34 a capacity is formed, with a part of the sleeve 19 as a dielectric. This capacity increases with the increase in the value of the screen voltage and reduction of the thickness of the dielectric which amounts to not more than 3 mm.

The above-described arrangement operates in the following manner. During the operation of the ignition device the junction element 23 of the spark plug connector 14 which is connected with the high voltage terminal of the ignition coil 13 has the outlet voltage of the ignition coil 13. The junction element 23 is connected via the connecting element 21 with the high voltage switching element 22. The high voltage switching element 22 transfers, when reaching a trigger voltage, in a jump-like manner from an electrically blocking condition to an electrically conducting condition in a reversible way. A voltage which further on will be identified as a voltage jump is provided at the side of the high voltage switching element 22 which faces away from the connecting element 21, during switching to the conductive condition. This voltage jump is smaller than the trigger voltage. The voltage jump is supplied to the junction part 24 for receiving the terminal pin 26 of the spark plug 17. The spark plug 17 in its longitudinal extension has an interference-suppression resistor 37 and is provided at the end side with the middle electrode 29. The middle electrode is controlled by the high voltage switching element 22 and supplies the voltage jump with regard to the neighboring mass electrode 28 which is at ground potential in the switching-through condition of the high voltage switching element 22. The latter occurring ignition voltage leads in a known manner through the spark discharge between the middle electrode 29 and the mass electrode 28 to an ignition of a fuel-air mixture in an associated cylinder of the internal combustion engine.

The voltage jump is a partial voltage of the trigger voltage, which depends on the design of the high voltage switching element 22 in a structurally specific way. The trigger voltage is also smaller than the output voltage of the ignition coil by a voltage loss.

The voltage loss is changeable by the capacity distribution in the spark plug connector 14. It increases with the increase of the sum of the pre-capacity and post-capacity relative to the pre-capacity, depending on the location of the high voltage switching element 22 and the direction of the energy flow from the ignition coil 13 to the spark plug 17. By separate increase of the pre-capacity, the voltage loss is reduced, which is realized by the capacity formed between the metal cup 32 and the screen 34 and located in the direction of the energy flow from the high voltage element 22.

Thereby the ignition device is provided, which with a pre-determined ignition voltage, has a high voltage switching element 22 with low trigger voltage and an ignition coil 13 with low output voltage, and therefore with operational safety can be produced in a cost-favorable way.

It will be understood that each of the elements described above, or two or more together, may also find a useful application in other types of constructions differing from the types described above.

While the invention has been illustrated and described as embodied in a connection part for an ignition device of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A connection part for an ignition device, arranged between an ignition coil and a spark plug for incorporating in a cylinder head of an internal combustion engine, the connection part comprising an isolation housing; a high voltage switching element located in said isolation housing and during application of a trigger voltage transferred reversibly in an electrically jump-like fashion to an electrically conductive condition; a first junction element located at one end of said high voltage switching element and connected with one pole of the latter and also connectable with a high voltage terminal of the ignition coil which leads to an output voltage of the ignition coil; a second junction element provided at another end of said high voltage switching element and connected with another pole of the latter and provided for receiving a terminal pin of the spark plug; and means associated with said isolation housing for increasing a capacity region between said high voltage switching element and said first junction element.

2. A connection part as defined in claim 1, wherein said means includes a tubular capacitor located outside said isolation housing.

3. A connection part as defined in claim 2, wherein said capacitor is double-walled and extends between said first junction element and said second junction element at an outer side of said isolation housing.

4. A connection part as defined in claim 3, wherein said capacitor includes a metal cup which forms one capacitor pole; an isolation surface forming a dielectric and surrounding said metal cup; and a metal screen forming another capacitor pole and surrounding said isolation surface.

5. A connection part as defined in claim 4, wherein said metal cup has a high voltage potential while said screen has a lower voltage potential.

6. A connection part as defined in claim 5, wherein said metal cup is electrically connectable with an output voltage of the ignition coil while said screen carries a voltage which is less than the output voltage of the ignition coil.

7. A connection part as defined in claim 6, wherein said screen is electrically at ground potential.

8. A connection part as defined in claim 4, wherein said screen is provided with springy tongues bringable in a power connection and electrical connection with the cylinder head which is at ground potential.

9. A connection part as defined in claim 7, wherein said screen together with the ignition coil is mountable on a cylinder head and is in electrical connection with the cylinder head which is at ground potential.

10. A connection part as defined in claim 4, wherein said dielectric is formed as a thin-walled layer with a thickness less than 3 mm.

11. A connection part as defined in claim 1, wherein said isolation housing with said high voltage switching element and said junction elements together form a spark plug connector.

* * * * *